US012655542B2

(12) United States Patent
Tanaka et al.

(10) Patent No.: US 12,655,542 B2
(45) Date of Patent: Jun. 16, 2026

(54) CARBON FIBER, MANUFACTURING METHOD THEREOF, AND CARBON FIBER COMPOSITE MATERIAL

(71) Applicant: TORAY Industries, Inc., Tokyo (JP)

(72) Inventors: Fumihiko Tanaka, Iyo-gun (JP); Yuki Suga, Iyo-gun (JP)

(73) Assignee: TORAY INDUSTRIES, INC., Tokyo (JP)

( * ) Notice: Subject to any disclaimer, the term of this patent is extended or adjusted under 35 U.S.C. 154(b) by 842 days.

(21) Appl. No.: 17/801,834

(22) PCT Filed: Mar. 5, 2021

(86) PCT No.: PCT/JP2021/008661
§ 371 (c)(1),
(2) Date: Aug. 24, 2022

(87) PCT Pub. No.: WO2021/187160
PCT Pub. Date: Sep. 23, 2021

(65) Prior Publication Data

US 2023/0087492 A1 Mar. 23, 2023

(30) Foreign Application Priority Data

Mar. 19, 2020 (JP) ..... 2020-049017

(51) Int. Cl.
*D01F 9/22* (2006.01)
*D01F 6/18* (2006.01)
*D01F 9/12* (2006.01)

(52) U.S. Cl.
CPC ..... *D01F 9/22* (2013.01); *D01F 6/18* (2013.01); *D01F 9/12* (2013.01); *Y10T 428/2918* (2015.01)

(58) Field of Classification Search
None
See application file for complete search history.

(56) References Cited

U.S. PATENT DOCUMENTS

| | | | | |
|---|---|---|---|---|
| 2002/0009588 | A1 | 1/2002 | Matsuhisa et al. | |
| 2007/0196648 | A1 | 8/2007 | Endo et al. | |
| 2010/0254887 | A1 | 10/2010 | León Y León | |
| 2011/0038788 | A1* | 2/2011 | Tanaka | D01F 9/22 526/341 |
| 2017/0067187 | A1 | 3/2017 | Watanabe et al. | |
| 2020/0385892 | A1 | 12/2020 | Saito et al. | |

FOREIGN PATENT DOCUMENTS

| | | | | | |
|---|---|---|---|---|---|
| CN | 106222804 | A | * | 12/2016 | D01F 9/22 |
| EP | 3 425 091 | A1 | | 1/2019 | |
| JP | 11-152626 | A | | 6/1999 | |
| JP | 11-241230 | A | | 9/1999 | |
| JP | H11241230 | A | * | 9/1999 | |
| JP | 2002-69754 | A | | 3/2002 | |
| JP | 2004-197278 | A | | 7/2004 | |
| JP | 2004-211240 | A | | 7/2004 | |
| JP | 2004-238761 | A | | 8/2004 | |
| JP | 2005-256211 | A | | 9/2005 | |
| JP | 2008-163537 | A | | 7/2008 | |
| JP | 2017-137614 | A | | 8/2017 | |
| JP | 2018-59087 | A | | 4/2018 | |
| WO | WO 97/45576 | A1 | | 12/1997 | |
| WO | WO 2008/040963 | A1 | | 4/2008 | |
| WO | WO 2015/133514 | A1 | | 9/2015 | |
| WO | WO 2019/087766 | A1 | | 5/2019 | |

OTHER PUBLICATIONS

International Search Report, issued in PCT/JP2021/008661, dated May 18, 2021.
Written Opinion of the International Searching Authority, issued in PCT/JP2021/008661, dated May 18, 2021.
Extended European Search Report for European Application No. 21772130.7, dated Nov. 12, 2024.

* cited by examiner

*Primary Examiner* — Marla D Mcconnell
*Assistant Examiner* — Kevin Worrell
(74) *Attorney, Agent, or Firm* — Birch, Stewart, Kolasch & Birch, LLP

(57) ABSTRACT

Provided is a carbon fiber with a strand modulus of elasticity from 240 to 300 GPa, an elongation of 2.65% or more, and a strain energy density of 95 J/mm$^3$ or more, which can improve the impact resistance of carbon fiber composite materials.

6 Claims, No Drawings

CARBON FIBER, MANUFACTURING METHOD THEREOF, AND CARBON FIBER COMPOSITE MATERIAL

TECHNICAL FIELD

The present invention relates to a carbon fiber with high elongation and high energy absorption capacity and a method of producing the same, and to a carbon fiber composite material in which the same carbon fiber is used.

BACKGROUND ART

Polyacrylonitrile-based carbon fibers are materials that are light in weight and high in strength and elastic modulus and are essential for component weight reduction. In addition, an characteristic of the carbon fibers is elastic deformation, but not plastic deformation, occurring when the carbon fibers are stressed. Therefore, an advantage of the carbon fibers is that the carbon fibers have a larger usable range of elongation than metals with high plastic deformation capacity.

In recent years, carbon fiber composite materials may be required to satisfy demands for both light weight and high impact resistance. In order to satisfy the demands, investigations are being made, for example, on the composition of a resin used as a matrix and on a sizing agent to modify the interfacial property between carbon fibers and a matrix resin.

Several attempts have been made so far to improve the strand tensile strength or elongation of carbon fibers. In Patent Literature 1, carbon fibers with a strand tensile strength of up to 9.0 GPa (Example 8) are obtained by transformation of precursor fibers into fine fibers with reduced defects. Also in Patent Literature 2, carbon fibers with a strand tensile strength of up to 8.0 GPa (Example 14) and with an elongation of 2.60% (Comparative Examples 4 and 5) are similarly obtained by transformation of precursor fibers into fine fibers and subsequent stretching of the fine fibers. In Patent Literature 3, carbon fibers with a strand tensile strength of up to 8.4 GPa (Example 3) are obtained by increasing the fracture toughness value of the carbon fibers. In Patent Literature 4, carbon fibers with an elongation of up to 2.68% (Example 15) are obtained using a technique that rarely causes reduction of strand tensile strength even if the diameter of a single carbon fiber is increased. In Patent Literature 5, conditions for carbon fiber production, such as conditions on polymers, spinning, and oxidizing, are adjusted for achieving a high elongation value, and carbon fibers with an elongation of up to 2.36% (Example 1) are obtained. In Patent Literature 6, carbon fibers with an elongation of up to 2.60% (Example 4) are obtained, for example, by reducing the maximum temperature during the carbonization step for maximizing the elongation of the carbon fibers. In Patent Literature 7, modification of the surface properties of carbon fibers is described in the context of production of carbon fibers with high strength and high elongation, but the obtained carbon fibers have an elongation of around 2.1%, which is a standard technical level observed in high-strength carbon fibers. In Patent Literature 8, carbon fibers with an elongation of up to 2.71% (Example 4) are obtained, for example, by addition of boron to a polymer.

Moreover, in Patent Literature 9, a modifier is added to a thermoplastic resin used as a matrix, for the purpose of increasing the impact resistance of carbon fiber composite materials.

CITATION LIST

Patent Literature

Patent Literature 1: JP Hei-11-241230
Patent Literature 2: WO 2008/40963
Patent Literature 3: JP 2017-137614
Patent Literature 4: WO 97/45576
Patent Literature 5: JP 2008-163537
Patent Literature 6: JP 2005-256211
Patent Literature 7: JP 2002-69754
Patent Literature 8: JP Hei-11-152626
Patent Literature 9: JP 2018-59087

SUMMARY OF INVENTION

Technical Problem

However, the conventional techniques have the following problems.

As for the technique of Patent Literature 1, the carbon fibers, which had a small single-fiber diameter, were high in strand modulus of elasticity and low in elongation as well as low in strain energy per fiber, which made it difficult to ensure enough impact resistance under a bending stress field.

As for the technique of Patent Literature 2, the carbon fibers, which had a small single-fiber diameter, were low in strain energy per fiber and additionally involved a problem of inadequate elongation.

As for the technique of Patent Literature 3, the carbon fibers had a problem of inadequate elongation and were high in strand modulus of elasticity, which made it difficult to ensure enough impact resistance under a bending stress field.

As for the technique of Patent Literature 4, the carbon fibers had insufficient levels of strand tensile strength and elongation, which made it difficult to ensure enough impact resistance. In addition, it was not envisaged that both strand tensile strength and elongation would be maintained at acceptable levels.

As for the technique of Patent Literature 5, it was difficult for the carbon fibers to ensure enough impact resistance.

As for the technique of Patent Literature 6, the carbon fibers had a very low level of strand modulus of elasticity, which made it difficult to ensure enough impact resistance.

As for the technique of Patent Literature 7, the carbon fibers had a very low level of elongation, which made it difficult to ensure enough impact resistance.

As for the technique of Patent Literature 8, the carbon fibers had an increased elongation, but the strand tensile strength was low in the carbon fibers with a higher elongation value. In addition, it was not envisaged that both strand tensile strength and elongation would be maintained at acceptable levels because the concept of strain energy density was dismissed. As described above, none of the carbon fibers have fulfilled all the requirements in terms of single-fiber diameter, strand modulus of elasticity, elongation, and strain energy density.

Moreover, in Patent Literature 9, the composition of the thermoplastic resin was designed considering the impact resistance of a carbon fiber composite material, but the mechanical properties of carbon fibers in the carbon fiber composite material are not described.

An object of the present invention is to provide a carbon fiber which can improve the impact resistance of carbon fiber composite materials.

Solution to Problem

In order to achieve the object as described above, a carbon fiber according to the present invention has a strand modulus of elasticity from 240 to 300 GPa, an elongation of 2.65% or more, and a strain energy density of 95 J/mm$^3$ or more.

Additionally, a method of producing a carbon fiber of the invention includes a first oxidation process in which a polyacrylonitrile-based carbon fiber-precursor fiber is subjected to a oxidation treatment over a period of 8 to 25 minutes until the resulting fiber has a peak intensity ratio of the infrared spectrum at 1,453 cm$^{-1}$ to that at 1,370 cm$^{-1}$ ranging from 0.98 to 1.10, a second oxidation process in which the fiber obtained in the first oxidation process is subjected to a oxidation treatment over a period of 5 to 14 minutes until the resulting fiber has a peak intensity ratio of the infrared spectrum at 1,453 cm$^{-1}$ to that at 1,370 cm$^{-1}$ ranging from 0.70 to 0.75 and a peak intensity ratio of the infrared spectrum at 1,254 cm$^{-1}$ to that at 1,370 cm$^{-1}$ ranging from 0.50 to 0.65, a pre-carbonization step in which the fiber obtained in the second oxidation process is pre-carbonized in an inert atmosphere at a maximum temperature of 500 to 1,200° C. while being stretched at a draw ratio ranging from 1.16 to 1.25, a carbonization step in which the fiber obtained in the pre-carbonization step is carbonized in an inert atmosphere at a maximum temperature of 1,000 to 1,500° C. under conditions where the duration of the treatment at the maximum temperature ranges from 20 to 60 seconds and the temperature rising rate ranges from 0.40 to 1.1° C./sec, and a step in which the fiber obtained in the carbonization step is modified by an electrolytic surface treatment to obtain the carbon fiber.

Advantageous Effects of Invention

The impact resistance of a carbon fiber composite material can be improved by using a carbon fiber according to the present invention.

DESCRIPTION OF EMBODIMENTS

In an attempt to improve the impact resistance of carbon fiber composite materials, the inventors focused on the strain energy density of carbon fibers. The strain energy density is defined as the area under a stress-strain curve obtained by tensile testing of a resin-impregnated strand (hereinafter sometimes referred to shortly as "strand"). However, in the present invention, an approximate value of the strain energy density is determined by dividing the product of the strand tensile strength (MPa=J/mm$^3$) and elongation (–), as described above, by 2 because correct calculation of the non-linearity is difficult. Carbon fibers with a high strain energy density can be expected to increase the impact resistance of an obtained carbon fiber composite material.

The carbon fiber of the invention has a strain energy density of 95 J/mm$^3$ or more, preferably 100 J/mm$^3$ or more, more preferably 105 J/mm$^3$ or more, still more preferably 110 J/mm$^3$ or more. The carbon fiber with a strain energy density of 95 J/mm$^3$ or more will often have sufficient energy absorption capacity. The carbon fiber with a strain energy density of 140 J/mm$^3$ will have a saturated degree of energy absorption capacity in balance with other properties, though no upper limit is imposed on the strain energy density. The strain energy density can be regulated by adjusting the conditions for carbon fiber production so as to maintain both strand tensile strength and elongation at acceptable levels.

The carbon fiber of the invention has a strand modulus of elasticity from 240 to 300 GPa, preferably from 250 to 290 GPa, more preferably from 250 to 280 GPa. The strand modulus of elasticity is an indicator that indicates the resistance of a carbon fiber to deformation under application of load. The strand modulus of elasticity of the carbon fiber can be analyzed in accordance with the tensile testing of a resin-impregnated strand described in JIS R7608: 2004. The stress-strain curve of the carbon fiber is convex and indicates a non-linearity, and the strand modulus of elasticity calculated from the stress-strain curve in the strain range from 0.1 to 0.6% is used in the present invention. The carbon fiber with a strand modulus of elasticity of 240 GPa or more will likely have a higher strain energy density. The carbon fiber with a strand modulus of elasticity of 300 GPa or less will have high compressive strength and have high energy absorption capacity. The strand modulus of elasticity can be regulated depending on, for example, the maximum temperature, the duration of heat treatment at the maximum temperature, the temperature rising rate, and/or the draw ratio in the carbonization step.

The carbon fiber of the invention preferably has a strand tensile strength of 7.5 GPa or more, more preferably 7.8 GPa or more, still more preferably 8.0 GPa or more. The strand tensile strength is an indicator that indicates the resistance of a carbon fiber to fracture under application of load. The strand tensile strength of the carbon fiber can be analyzed in accordance with the tensile testing of a resin-impregnated strand described in JIS R7608: 2004. The carbon fiber with a strand tensile strength of 7.5 GPa or more will likely have a higher strain energy density. The carbon fiber with a strand tensile strength of 8.8 GPa will easily provide an adequate level of strain energy density, though no upper limit is imposed on the strand tensile strength. The strand tensile strength can be regulated through production of a carbon fiber according to the production method as described below including, for example, defect suppression and improvement of fracture toughness value.

The carbon fiber of the invention has an elongation of 2.65% or more, preferably 2.75% or more, more preferably 2.85% or more, still more preferably 2.95% or more. The elongation of the carbon fiber can be analyzed in accordance with the tensile testing of a resin-impregnated strand described in JIS R7608: 2004. Since a stress-strain curve indicates a non-linearity, the measurement of elongation of a carbon fiber is difficult. However, in the present tensile testing, the elongation is calculated by dividing the above strand tensile strength by the strand modulus of elasticity. The carbon fiber with an elongation of 2.65% or more will likely have a higher strain energy density. The carbon fiber with an elongation of 3.20% will be often enough to have a higher strain energy density. The elongation of the carbon fiber can be adjusted by regulating the conditions for carbon fiber production so as to maintain both strand tensile strength and strand modulus of elasticity at acceptable levels.

The carbon fiber of the invention preferably has a single-fiber diameter of 4.0 μm or more, more preferably 4.5 μm or more, still more preferably 5.0 μm or more, particularly preferably 5.3 μm or more. Because the breaking load per fiber is determined from the strand tensile strength and cross-sectional area of a single fiber, the breaking load per fiber is affected by the single-fiber diameter. In addition, the carbon fiber with a larger single-fiber diameter has a tendency to have higher single-fiber compressive strength and to have higher energy absorption capacity. Accordingly, the carbon fiber with a single-fiber diameter of 4.0 μm or more will likely have higher energy absorption capacity. The carbon fiber with a single-fiber diameter of up to 7.5 μm will often provide sufficient impact resistance. The diameter of a single carbon fiber can be calculated from the total fineness, density, and filament count of the carbon fiber. Moreover, in cases where the filament count is unknown, the single-fiber diameter can be determined by embedding carbon fibers in a resin to observe cross sections under light microscope and then measuring the cross-sectional area of each single fiber by image analysis for calculation of an equivalent circle diameter. In cases where the measurement methods produce different values, the value obtained by the former method will be adopted. The diameter of the single fiber can be regulated by the diameter of a precursor fiber and the draw ratio for the subsequent process.

In order to increase the impact resistance of a carbon fiber composite material, it is important that the carbon fiber of the invention has a single-fiber diameter, a strand modulus of elasticity, an elongation, and a strain energy density which all fall within the above ranges.

The carbon fiber of the invention preferably has a total fineness of 0.8 g/m or more, more preferably 0.9 g/m or more. The total fineness refers to the mass per meter of a tow of carbon fiber and is related to the single-fiber diameter and filament count of the carbon fiber. The production of a carbon fiber composite material is more easily increased when the carbon fiber has a higher total fineness. Accordingly, the carbon fiber with a total fineness of 0.8 g/m or more will allow efficient production of a carbon fiber composite material with excellent impact resistance. Preferably, the carbon fiber with a total fineness of 2.0 g/m or less will allow production of a carbon fiber composite material that has an appropriate thickness and consequently has higher impact resistance. The total fineness can be regulated by adjusting the single-fiber diameter or the filament count. However, if the filament count is very high, it becomes difficult to produce uniform products consistently and the resulting products tend to have a lower strand tensile strength.

The carbon fiber of the invention preferably has a density from 1.75 to 1.85 g/cm$^3$. The carbon fiber with a higher density has a denser microstructure and will likely have an increased strand tensile strength. Accordingly, the carbon fiber with a density of 1.75 g/cm$^3$ or more will likely have an adequate level of energy absorption capacity, and the carbon fiber with a density of 1.85 g/cm$^3$ or less will have high elongation and easily maintain high energy absorption capacity. The lower limit of the density is more preferred to be 1.78 g/cm$^3$. The upper limit of the density is more preferred to be 1.83 g/cm$^3$. The density of the carbon fiber can be regulated by the draw ratio and/or the temperature rising rate during the carbonization step.

Next, a preferred carbon fiber production method will be described, which is suitable for production of carbon fibers according to the present invention.

As an industrial method for carbon fiber production, a method including the following steps is known: a oxidation process in which polyacrylonitrile-based carbon fiber-precursor fibers (hereinafter sometimes referred to simply as "precursor fibers") are converted into oxidated fibers in an oxidative atmosphere at a temperature of 200 to 310° C., a pre-carbonization step in which the oxidated fibers are pre-carbonized in an inert atmosphere at a temperature of 500 to 1,200° C., and a carbonization step in which the resulting fibers are carbonized in an inert atmosphere at a temperature of 1,000 to 1,500° C.

A polyacrylonitrile-based polymer is preferably used as a raw material for use in production of precursor fibers. In the present invention, the polyacrylonitrile-based polymer is a polymer containing at least from 90 to 100% by mole of acrylonitrile. In the production of precursor fibers, the polyacrylonitrile-based polymer preferably contains a copolymer component for increasing the strand tensile strength. As a monomer that can be used as the copolymer component, a monomer containing one or more carboxylic acid or amide groups is suitable for use, considering acceleration of oxidation.

In the production of precursor fibers, either a dry-wet spinning method or a wet spinning method may be used as a spinning method, but a dry-wet spinning method is more suitable for use than the other because of its advantage to the strand tensile strength of obtained carbon fibers. Preferably, a spinning process based on the dry-wet spinning method includes a spinning step in which a spinning solution is extruded through a spinneret into a coagulation bath to form fibers, a water washing step in which the fibers obtained in the spinning step are washed and stretched in a water bath, and a heat-drying step in which the fibers obtained in the water washing step are dried under heat, and the spinning process includes a steam stretching step, if necessary, in which the fibers obtained in the heat-drying step are stretched in steam. The order of the steps can be varied as appropriate. The spinning solution is a solution of the aforementioned polyacrylonitrile-based polymer in a solvent, such as dimethyl sulfoxide, dimethylformamide, or dimethylacetamide, which can dissolve a polyacrylonitrile.

Preferably, the coagulation bath contains the solvent used for the spinning solution, such as dimethyl sulfoxide, dimethylformamide, or dimethylacetamide, and a so-called coagulation accelerator. As the coagulation accelerator, a substance that does not dissolve the polyacrylonitrile-based polymer but is compatible with the solvent used for the spinning solution can be used. Specifically, water is suitable for use as the coagulation accelerator.

As the water washing process for the water washing step, a water washing process involving multiple stages is suitable for use, in which the temperature is increased from 30 to 98° C. Additionally, the draw ratio in the water washing step preferably ranges from 2 to 6. Subsequently, an oil agent made of, for example, silicone is preferably applied to the fibers, for the purpose of improving the strand tensile strength. As the silicone oil agent, an agent containing an amino-modified silicone is suitable for use.

For the heat-drying step, a known method can be used. For example, a temperature of from 100 to 200° C. is exemplified as the drying temperature.

After the aforementioned water washing and heat-drying steps, the steam stretching process is performed as necessary to produce precursor fibers, which are suitable for production of carbon fibers according to the present invention. The steam stretching process is preferably performed at a draw ratio ranging from 2 to 6 in pressurized steam.

Preferably, the oxidation process is regulated such that the obtained oxidated fibers have a peak intensity ratio of the infrared spectrum at 1,453 cm$^{-1}$ to that at 1,370 cm$^{-1}$ ranging from 0.70 to 0.75 and a peak intensity ratio of the infrared spectrum at 1,254 cm$^{-1}$ to that at 1,370 cm$^{-1}$ ranging from 0.50 to 0.65, to increase the strand tensile strength in carbon fibers. The peak of the infrared spectrum at 1,453 cm$^{-1}$ comes from alkene, and the peak intensity decreases as the oxidation process proceeds. The peaks at 1,370 $cm^{-1}$ and 1,254 $cm^{-1}$ come from an oxidated structure, and the peak intensities increase as the oxidation process proceeds. Standard oxidated fibers having a specific gravity of 1.35 have a peak intensity ratio of that at 1,453 $cm^{-1}$ to that at 1,370 $cm^{-1}$ ranging from about 0.63 to 0.69, which indicates that it is preferable that more alkene-derived structures are left in the oxidated fibers obtained in the oxidation process of the invention than in the standard oxidated fibers. The peak intensity ratio of that at 1,254 $cm^{-1}$ to that at 1,370 $cm^{-1}$ decreases as the oxidation process proceeds, in which the peak intensity ratio decreases greatly, particularly at the early stage, but the peak intensity ratio may not drop below 0.65 under some oxidation conditions even if the time spent for oxidation is extended.

In order to maintain both the two peak intensity ratios within the intended ranges, the conditions for the process should be basically established considering mainly the following aspects: the amount of the copolymer component contained in the polyacrylonitrile-based polymer, which forms precursor fibers, is reduced; the crystal orientation of precursor fibers is increased; the single-fiber fineness of precursor fibers is reduced; and the temperature for oxidation (oxidation temperature) is increased during the late stage of the process. Specifically, it is preferable that the oxidation process is performed, divided into two steps: a first oxidation process in which the oxidation process proceeds over a period of 8 to 25 minutes, preferably of 8 to 15 minutes, until the resulting fibers have a peak intensity ratio of the infrared spectrum at 1,453 $cm^{-1}$ to that at 1,370 $cm^{-1}$ ranging from 0.98 to 1.10, and a second oxidation process in which the fibers obtained in the first oxidation process are subjected to the oxidation process over a period of 5 to 14 minutes, preferably of 5 to 10 minutes, until the resulting fibers have a peak intensity ratio of the infrared spectrum at 1,453 $cm^{-1}$ to that at 1,370 $cm^{-1}$ ranging from 0.70 to 0.75 and a peak intensity ratio of the infrared spectrum at 1,254 $cm^{-1}$ to that at 1,370 $cm^{-1}$ ranging from 0.50 to 0.65.

It is preferable that the oxidation temperature in the first oxidation process is adjusted to a temperature preferably from 200 to 250° C., more preferably from 230 to 250° C., to make sure that the peak intensities of the infrared spectrum are regulated in the ranges as described above.

The oxidation temperature in the second oxidation process is higher than the temperature in the first oxidation process. The oxidation temperature in the second oxidation process should be increased to reduce the time of oxidation, but the suitable oxidation temperature depends on the characteristics of precursor fibers. It is preferable that the oxidation temperature is adjusted to a temperature preferably from 280 to 310° C., more preferably from 280 to 300° C., still more preferably from 285 to 295° C., to make sure that the peak intensities of the infrared spectrum are regulated in the ranges as described above. The oxidation temperature is not necessarily constant, or the oxidation process may be a multi-stage temperature cycle. A combination of a high oxidation temperature and a short oxidation time is preferred to increase the strand tensile strength of obtained carbon fibers.

In the present invention, the oxidation process refers to heat treatment of precursor fibers in an oxygen-containing atmosphere at a temperature(s) of from 200 to 310° C.

The term "oxidation time" as used herein means the time during which fibers are placed in a oxidation furnace. The term "oxidated fibers" means fibers following the oxidation process and followed by the pre-carbonization step. Additionally, the term "peak intensity" as used herein refers to the absorbance of the oxidated fibers at each wavelength, which is determined by sampling a small amount of the oxidated fibers, measuring the infrared spectrum of the sample, and applying baseline correction to the measured data, to which peak splitting is not particularly applied. Moreover, the infrared spectrum of the sample is measured after the sample is diluted with KBr to a concentration of 0.67% by mass. Every time conditions set for oxidation are changed, the conditions should be evaluated by measuring the infrared spectrum as described above and following a preferred manufacturing method as described below. The peak intensity ratios of the infrared spectrum of the oxidated fibers can be appropriately regulated for controlling the strand tensile strength of obtained carbon fibers.

In the oxidation process, the total treatment time can be appropriately selected and preferably selected from the range of 13 to 20 minutes. Additionally, the time of the oxidation treatment will be set so as to make sure that the specific gravity of obtained oxidated fibers preferably ranges from 1.28 to 1.32, more preferably from 1.30 to 1.32, for the purpose of increasing the strand tensile strength of obtained carbon fibers. A more preferred treatment period during the oxidation process is dependent on the oxidation temperature. Unless the oxidated fibers have a specific gravity of 1.28 or more, the strand tensile strength may be reduced in obtained carbon fibers. In cases where the oxidated fibers have a specific gravity of 1.32 or less, the strand tensile strength can be increased. The specific gravity of the oxidated fibers will be regulated by the treatment period and oxidation temperature during the oxidation process. Additionally, switching from the first oxidation process to the second oxidation process occurs preferably at a timing when the specific gravity of the fibers falls within the range from 1.21 to 1.23. Also in this step, a priority is placed on adjusting the conditions for the oxidation process so as to make sure that the intensity ratios of the infrared spectrum is within the ranges described above. Preferred ranges of the duration of oxidation treatment and the oxidation temperature vary depending on the characteristics of the precursor fibers and/or the copolymerization composition of the polyacrylonitrile-based polymer.

In the pre-carbonization step to pre-carbonize the fiber tow obtained in the oxidation process, the obtained oxidated fibers is subjected to heat treatment in an inert atmosphere at a maximum temperature of 500 to 1,200° C. until the fibers have a specific gravity, preferably a specific gravity from 1.5 to 1.8. In the pre-carbonization step, the draw ratio is preferably in the range from 1.16 to 1.25. In cases where the draw ratio during the pre-carbonization step is 1.16 or more, the strand modulus of elasticity is easily increased, and the strand tensile strength is easily increased. In cases where the draw ratio during the pre-carbonization step is 1.25 or less, the strand modulus of elasticity is easily maintained at 300 GPa or less.

The pre-carbonized fibers are preferably carbonized in an inert atmosphere at a maximum temperature of 1,000 to 1,500° C., more preferably at a maximum temperature of 1,100 to 1,300° C., still more preferably at a maximum temperature of 1,150 to 1,250° C. A lower temperature is preferred as the maximum temperature in the carbonization step from the viewpoint of increasing the elongation of obtained carbon fibers, but an excessively low maximum temperature may cause reduction of strand tensile strength. Thus, it is preferable that the maximum temperature is selected with consideration of the balance between both the properties.

Moreover, the duration X of the treatment at the maximum temperature in the carbonization step preferably ranges from 20 to 60 seconds, more preferably from 20 to 38 seconds. The duration X of the treatment at the maximum temperature in the carbonization step refers to the time required for the fibers to pass through a compartment with the maximum temperature in a carbonizing furnace. Many carbonizing furnaces have multiple compartments which each have a heater block to control and gradually increase the temperature, such that the temperature varies in each compartment. For convenience of calculation, the temperature is considered to be constant in each compartment. Because the strand modulus of elasticity can be maintained low by the treatment at the maximum temperature for a shorter period of time, the duration X of the treatment is preferred to be 60 seconds or shorter. In cases where the duration X of the treatment is 20 seconds or longer, the strand modulus of elasticity can be easily maintained stably.

In the carbonization step, the temperature rising rate Y is preferably from 0.40 to 1.1° C./sec, more preferably from 0.40 to 1.0° C./sec, still more preferably from 0.40 to 0.60° C./sec. The temperature rising rate during the carbonization step affects the rate of decomposition gas desorption and consequently influences the strand tensile strength. In the present invention, the temperature rising rate is defined as the rate of how many degrees in Celsius on average the temperature rises in one second while fibers travel compartments with temperatures of more than 1,000° C. in the carbonizing furnace, in which the temperature is controlled and gradually increased such that the temperature varies in each compartment. Specifically, in cases where fibers travel, for example, 100 seconds from a compartment with a temperature of 1,000° C. to a next compartment with a temperature of 1,100° C. in the carbonizing furnace, the temperature rising rate is 1.0° C./sec. Alternatively, in cases where fibers travel 200 seconds from a compartment with a temperature of 950° C. to a next compartment with a temperature of 1,150° C. in the carbonizing furnace, the temperature rising rate is 1.0° C./sec. Moreover, in cases where the maximum temperature during the carbonization step is set to a temperature of less than 1,100° C., the temperature rising rate for providing the maximum temperature is employed. That is, in cases where the maximum temperature is 1,050° C. and fibers travel 50 seconds from a compartment with a temperature of 1,000° C. to a next compartment with a temperature of 1,050° C. in the carbonizing furnace, the temperature rising rate is 1.0° C./sec. Preferably, the first compartment in the carbonizing furnace has a temperature of 1,000° C. or lower. In cases where the temperature rising rate as described above is 0.40° C./sec or more, the strand modulus of elasticity can be easily maintained stably. A temperature rising rate of 1.1° C./sec or less will easily prevent the strand tensile strength from decreasing.

In the carbonization step, the duration X of the treatment at the maximum temperature and the temperature rising rate Y preferably satisfy the inequation: $0.015X \leq Y \leq 0.015X+0.6$. This inequation is derived from studies made by the inventors in order to increase the elongation of carbon fibers. The duration X of the treatment and the temperature rising rate Y are individually adjusted so as to satisfy the relation, and the elongation of the carbon fibers is easily increased as a consequence.

Preferably, the thus-obtained carbon fibers are further subjected to an electrolytic surface treatment, in order to introduce oxygen-containing functional groups. As the electrolytic surface treatment, any of gaseous-phase oxidation, liquid-phase oxidation, or liquid-phase electrolytic oxidation may be applied, but liquid-phase electrolytic oxidation is suitable for application from the viewpoint of high productivity and feasibility of uniform processing. In the present invention, the liquid-phase electrolytic oxidation is not limited to a specific method and may be performed by a known method.

After the electrolytic surface treatment, the obtained carbon fibers can be subjected to a sizing treatment, to provide the bundling property to the carbon fibers. As an agent for the sizing treatment, a sizing agent having high compatibility with a matrix resin used for a carbon fiber composite material can be appropriately selected depending on the type of the matrix.

Next, a carbon fiber composite material according to the present invention will be described. The carbon fiber composite material of the invention comprises carbon fibers of the invention as described above and a matrix resin.

The carbon fibers suitable for use for the present invention may be continuous or discontinuous fibers. In addition, the content of carbon fibers in the carbon fiber composite material preferably ranges from 15 to 65% by volume.

The matrix resin used in the carbon fiber composite material of the invention may be a thermosetting resin or a thermoplastic resin.

Examples of the thermosetting resin suitable for use in the present invention include epoxy resins, vinyl ester resins, phenolic resins, and unsaturated polyester resins. The thermosetting resin may be a resin that undergoes a cross-linking reaction upon heating to form, at least in part, a three-dimensional cross-linked structure.

Additionally, a prepreg can be exemplified as a molding base material for forming a carbon fiber composite material. The thermosetting resin in the prepreg is preferred to be in a semi-solid form and with high tackiness because prepregs need to be adhesively bonded together or laminated in a mold for multilayer lamination. Among the resins, epoxy resins are preferred considering the tackiness of prepregs in the bonding process and the mechanical properties of a molded product made from those prepregs.

In cases of using a thermosetting resin, for example, a method of autoclave prepreg molding, a method of resin transfer molding for molding a preform in the form of woven fabric or the like, or a method of filament winding for molding a prepreg is exemplified as a method of molding a carbon fiber composite material.

The thermoplastic resin suitable for use in the present invention is preferred to be at least one thermoplastic resin selected from the group consisting of polyolefins, polyamides, polyesters, polycarbonates, and polyarylene sulfides. Polyamides and polyarylene sulfides are more preferred from the viewpoint of the impact resistance of an obtained carbon fiber composite material. Thermoplastic resins can be widely used because the impact resistance of an obtained carbon fiber composite material can be increased by combining a thermoplastic resin with carbon fibers of the invention, regardless the type of the thermoplastic resin.

As for the molding of a carbon fiber composite material in which a thermoplastic resin is used, a carbon fiber tow and a thermoplastic resin are combined together by a known method such as melt impregnation, melt kneading, or slurry impregnation, and the carbon fiber tow in the mixture may be used directly as continuous fibers or used as discontinuous fibers after being cut by a tool such as a pelletizer or a strand cutter to a constant length of 1 to 50 mm.

A continuous fiber tape or a discontinuous fiber material, which is composed of the carbon fiber tow and the thermoplastic resin, can be molded to produce a finished carbon fiber composite material. For example, it can be indicated that the production is based on a known molding method, such as press molding, injection molding, injection compression molding, compression molding, vacuum molding, or extrusion molding.

The methods for measurement of various physical values used in the present invention are as described below.

<Total Fineness>

After a carbon fiber to be measured, which is 10 m in length, is sampled and completely dried at 120° C. for 2 hours, the mass of the carbon fiber sample is measured, and the measured value is divided by 10 to determine the total fineness of the carbon fiber, which is the mass per meter length.

<Density>

After a carbon fiber to be measured is completely dried at 120° C. for 2 hours, the carbon fiber is subjected to measurement. A dry-process automatic pycnometer is used for measurement of density, for which nitrogen is used as a measurement medium, and a 10-cc container is used as a sample container, and in which the volume of a sample is adjusted to a volume of 3 to 6 cc. The measurement is triplicated, and the mean of the measured values is used. In the present invention, a dry-process automatic pycnometer Accupyc 1330 manufactured by Shimadzu Corporation was used for the measurement.

<Single-Fiber Diameter>

The fiber diameter is calculated from the determined total fineness and density and the filament count of the carbon fiber used for the measurement of density.

<Strand Tensile Strength, Strand Modulus of Elasticity, Elongation>

The strand tensile strength, strand modulus of elasticity, and elongation of a carbon fiber are determined following the procedures below according to the test method of JIS R7608: 2004 for resin-impregnated strands. A resin is prepared using a 100/3/4 (parts by mass) of "CELLOXIDE" (registered trade name) 2021P (manufactured by Daicel Corporation)/boron trifluoride monoethyl amine (manufactured by Tokyo Chemical Industry Co., Ltd.)/acetone and is cured using the following conditions: temperature, 125° C.; pressure, normal atmospheric pressure; duration, 30 minutes. The strand tensile strength, strand modulus of elasticity, and elongation are measured for 10 carbon fiber strands, and the means of the measured values are used. A strain range from 0.1 to 0.6% will be used for calculation of strand modulus of elasticity.

<Strain Energy Density>

The strain energy density will be calculated by the following formula: Strain energy density ($J/mm^3$)=Strand tensile strength (GPa)×1,000×Elongation (%)/100/2.

<Impact Resistance of Carbon Fiber Composite Material>

Carbon fibers to be tested are blended with a thermoplastic polyphenylene sulfide resin ("TORELINA" (registered trade name) M2888 manufactured by Toray Industries, Inc.) in a mass ratio of 30:70 and melt-kneaded to prepare pellets. The obtained pellets are used in injection molding to produce an ISO standard dumbbell-shaped specimen as a molded product. The parallel portion is cut out from then ISO standard dumbbell-shaped specimen, and the Charpy impact test is performed on the V-notched specimen by using a C1-4-01 testing machine manufactured by Tokyo Testing Machine Co., Ltd. in accordance with ISO 179 (2010) to calculate the impact strength ($kJ/m^2$), and the impact resistance is evaluated based on the following criteria:

1: an impact strength of 13 $kJ/m^2$ or more;
2: an impact strength of 12 $kJ/m^2$ or more but less than 13 $kJ/m^2$;
3: an impact strength of 11 $kJ/m^2$ or more but less than 12 $kJ/m^2$;
4: an impact strength of less than 11 $kJ/m^2$.

EXAMPLES

The present invention will be described below in detail by way of examples, but the invention is not limited thereto.

Example 1

Coagulated filaments were obtained by dry-wet spinning, in which a spinning solution containing a polyacrylonitrile-based copolymer and dimethyl sulfoxide as a solvent was once extruded through a spinneret into the air and then submerged into a coagulation bath containing an aqueous solution of dimethyl sulfoxide to form the coagulated filaments.

The coagulated filaments were washed in water and then stretched at a draw ratio of 3.5 in a double warm water bath by conventional procedures. Subsequently, an amino-modified silicone-based silicone oil agent was applied to the fiber tow following the stretching in the water bath, and the resulting fiber tow was densified and dried using heating rollers at 160° C. After the number of single fibers reached 12,000, the single fibers were stretched at a draw ratio of 3.7 in pressurized steam, which resulted in a total draw ratio of 13 during the spinning process, and the resulting single fibers were then interlaced with each other to produce a carbon fiber-precursor fiber tow comprising 12,000 single fibers and having a crystalline orientation index of 93%. The single-fiber fineness of the carbon fiber-precursor fiber tow was 0.7 dtex.

Next, the carbon fiber-precursor fiber tow was subjected to a oxidation treatment in an oven with air atmosphere during the first and second oxidation processes, while being stretched at a draw ratio of 1 to produce oxidated fibers, in which a oxidation temperature of 250° C. and a oxidation time of 11 minutes were used as conditions for the first oxidation process, and a oxidation temperature of 280° C. and a oxidation time of 6 minutes were used as conditions for the second oxidation process.

After the first oxidation process, the fibers had a peak intensity ratio of the infrared spectrum at 1,453 $cm^{-1}$ to that at 1,370 $cm^{-1}$ of 1.04. After the second oxidation process, the fibers had a peak intensity ratio of the infrared spectrum at 1,453 $cm^{-1}$ to that at 1,370 $cm^{-1}$ of 0.70 and a peak intensity ratio of the infrared spectrum at 1,254 $cm^{-1}$ to that at 1,370 $cm^{-1}$ of 0.61.

The obtained oxidated fibers were pre-carbonized in nitrogen atmosphere at a maximum temperature of 800° C., while being stretched at a draw ratio of 1.20, to produce pre-carbonized fibers. The obtained pre-carbonized fibers were carbonized in nitrogen atmosphere at a maximum temperature of 1,200° C., while being stretched at a draw ratio of 0.950. The temperature rising rate during the carbonization step was 0.45° C./sec. The obtained carbon fibers were subjected to a surface treatment and coated with a sizing agent. The physical properties of the finished carbon fibers are shown in Table 1.

Examples 2 to 11 and Comparative Examples 1 to 7

Carbon fibers were produced in the same manner as in Example 1, except that the draw ratio in the pre-carbonization step and the draw ratio, maximum temperature, duration of treatment at maximum temperature, and temperature rising rate in the carbonization step were changed to those listed in Table 1. The physical properties of the obtained carbon fibers are shown in Table 1.

Reference Examples 1 to 3

Oxidated fibers were produced in the same manner as in Example 1, except that a oxidation temperature of 240° C. and a oxidation time of 82 minutes were used as conditions for the first oxidation process, and that a oxidation temperature of 250° C. and a oxidation time of 85 minutes were used as conditions for the second oxidation process.

After the first oxidation process, the fibers had a peak intensity ratio of the infrared spectrum at 1,453 $cm^{-1}$ to that at 1,370 $cm^{-1}$ of 0.68. After the second oxidation process, the fibers had a peak intensity ratio of the infrared spectrum at 1,453 $cm^{-1}$ to that at 1,370 $cm^{-1}$ of 0.50 and a peak intensity ratio of the infrared spectrum at 1,254 $cm^{-1}$ to that at 1,370 $cm^{-1}$ of 0.56.

The obtained oxidated fibers were pre-carbonized in nitrogen atmosphere at a maximum temperature of 800° C., while being stretched at a draw ratio of 1.17, to produce pre-carbonized fibers. The obtained pre-carbonized fibers were carbonized in nitrogen atmosphere under any of the conditions of maximum temperature and duration listed in Table 1, while being stretched at a draw ratio of 0.980. The temperature rising rate during the carbonization step was 0.35° C./sec. The obtained carbon fibers were subjected to a surface treatment and coated with a sizing agent. The physical properties of the finished carbon fibers are shown in Table 1. No significant change in strand tensile strength was observed when the maximum temperature in the carbonization step was changed, though variation in maximum temperature is generally used for regulating the strand modulus of elasticity. This indicates that the conditions for the pre-carbonization and carbonization steps demonstrated in the present examples should be finely tuned when the strand tensile strength is on a high level.

TABLE 1

| | Draw ratio in pre-carbonization step (—) | Draw ratio in carbonization step (—) | Maximum temperature in carbonization step (° C.) | Duration of treatment at maximum temperature in carbonization step (sec) | Temperature rising rate in carbonization step (° C./sec) |
|---|---|---|---|---|---|
| Example 1 | 1.20 | 0.950 | 1200 | 20 | 0.45 |
| Example 2 | 1.20 | 0.950 | 1200 | 40 | 0.42 |
| Example 3 | 1.20 | 0.950 | 1200 | 20 | 1.1 |
| Example 4 | 1.20 | 0.950 | 1500 | 60 | 1.0 |
| Comparative Example 1 | 1.20 | 0.960 | 1500 | 180 | 0.35 |
| Comparative Example 2 | 1.20 | 0.960 | 1300 | 180 | 0.65 |
| Comparative Example 3 | 1.20 | 0.960 | 1200 | 180 | 0.87 |
| Comparative Example 4 | 1.20 | 0.960 | 1200 | 60 | 0.29 |
| Comparative Example 5 | 1.20 | 0.950 | 1500 | 180 | 0.35 |
| Comparative Example 6 | 1.00 | 0.950 | 1500 | 180 | 0.35 |
| Example 5 | 1.21 | 0.950 | 1200 | 35 | 0.95 |
| Example 6 | 1.19 | 0.950 | 1200 | 60 | 1.1 |
| Example 7 | 1.22 | 0.950 | 1200 | 35 | 0.67 |
| Example 8 | 1.18 | 0.950 | 1200 | 60 | 1.1 |
| Example 9 | 1.18 | 0.950 | 1150 | 35 | 1.0 |
| Example 10 | 1.18 | 0.950 | 1100 | 35 | 0.89 |
| Comparative Example 7 | 1.18 | 0.950 | 1050 | 35 | 0.15 |
| Example 11 | 1.17 | 0.950 | 1200 | 20 | 0.41 |
| Reference Example 1 | 1.17 | 0.980 | 1500 | 180 | 0.35 |
| Reference Example 2 | 1.17 | 0.980 | 1350 | 180 | 0.35 |
| Reference Example 3 | 1.17 | 0.980 | 1200 | 180 | 0.35 |

| | Strand tensile strength (GPa) | Strand modulus of elasticity (GPa) | Elongation (%) | Single-fiber diameter (μm) | Total fineness (g/m) | Density ($g/cm^3$) | Strain energy density ($J/mm^3$) | Impact resistance |
|---|---|---|---|---|---|---|---|---|
| Example 1 | 8.0 | 265 | 3.02 | 5.1 | 0.45 | 1.83 | 121 | 1 |
| Example 2 | 7.3 | 273 | 2.67 | 5.1 | 0.45 | 1.83 | 98 | 3 |
| Example 3 | 7.2 | 263 | 2.74 | 5.1 | 0.45 | 1.82 | 99 | 3 |
| Example 4 | 8.0 | 300 | 2.67 | 5.1 | 0.45 | 1.83 | 107 | 2 |
| Comparative Example 1 | 8.4 | 325 | 2.58 | 5.0 | 0.43 | 1.83 | 109 | 3 |
| Comparative Example 2 | 7.5 | 305 | 2.46 | 5.0 | 0.43 | 1.83 | 92 | 4 |

TABLE 1-continued

| | | | | | | | | |
|---|---|---|---|---|---|---|---|---|
| Comparative Example 3 | 7.3 | 295 | 2.47 | 5.0 | 0.44 | 1.83 | 90 | 4 |
| Comparative Example 4 | 7.1 | 280 | 2.54 | 5.1 | 0.44 | 1.84 | 90 | 4 |
| Comparative Example 5 | 8.2 | 315 | 2.60 | 5.0 | 0.44 | 1.83 | 107 | 4 |
| Comparative Example 6 | 7.8 | 305 | 2.56 | 5.5 | 0.51 | 1.81 | 100 | 4 |
| Example 5 | 7.8 | 268 | 2.9 | 5.1 | 0.90 | 1.83 | 113 | 1 |
| Example 6 | 7.8 | 275 | 2.85 | 5.1 | 0.89 | 1.82 | 111 | 2 |
| Example 7 | 7.7 | 261 | 2.93 | 5.0 | 0.86 | 1.83 | 113 | 1 |
| Example 8 | 7.9 | 276 | 2.85 | 5.1 | 0.89 | 1.82 | 113 | 2 |
| Example 9 | 7.7 | 269 | 2.85 | 5.1 | 0.89 | 1.82 | 110 | 2 |
| Example 10 | 7.6 | 258 | 2.93 | 5.1 | 0.90 | 1.83 | 111 | 1 |
| Comparative Example 7 | 5.9 | 206 | 2.86 | 5.1 | 0.90 | 1.84 | 84 | 4 |
| Example 11 | 7.6 | 258 | 2.94 | 5.2 | 0.94 | 1.84 | 112 | 1 |
| Reference Example 1 | 5.5 | 314 | 1.75 | 5.5 | 0.50 | 1.75 | 48 | 4 |
| Reference Example 2 | 5.4 | 300 | 1.80 | 5.5 | 0.50 | 1.76 | 49 | 4 |
| Reference Example 3 | 5.6 | 285 | 1.96 | 5.5 | 0.50 | 1.77 | 55 | 4 |

INDUSTRIAL APPLICABILITY

The carbon fiber of the invention has high impact resistance and will allow a carbon fiber composite material with high energy absorption capacity to be produced with high productivity.

The invention claimed is:

1. A carbon fiber with a strand modulus of elasticity from 240 to 300 GPa, a percentage elongation at break of 2.75% or more, and a strain energy density of 95 J/mm$^3$ or more, wherein the carbon fiber comprises a plurality of single fibers having a diameter of 5.0 μm or more and 7.5 μm or less.

2. The carbon fiber according to claim 1, which has a single-fiber diameter of 5.3 μm or more.

3. The carbon fiber according to claim 2, which has a percentage elongation at break of 2.85% or more.

4. The carbon fiber according to claim 1, which has a strand tensile strength of 7.5 GPa or more.

5. The carbon fiber according to claim 1, which has a strain energy density of 100 J/mm$^3$ or more.

6. A carbon fiber composite material comprising carbon fibers according to claim 1 and a matrix resin.

* * * * *